United States Patent [19]

Unger

[11] Patent Number: 4,835,940

[45] Date of Patent: Jun. 6, 1989

[54] APPARATUS FOR CLOSING BOTTLES

[75] Inventor: Dieter Unger, Waltrop, Fed. Rep. of Germany

[73] Assignee: Holstein und Kappert Aktiengesellschaft, Dortmund, Fed. Rep. of Germany

[21] Appl. No.: 80,748

[22] Filed: Jul. 31, 1987

[30] Foreign Application Priority Data

Jul. 31, 1986 [DE] Fed. Rep. of Germany ..... 3626008

[51] Int. Cl.[4] ..... B65B 7/28

[52] U.S. Cl. ..... 53/342; 53/341; 53/344; 53/346; 53/367

[58] Field of Search ..... 53/334, 338, 341, 344, 53/346, 355, 367

[56] References Cited

U.S. PATENT DOCUMENTS

| | | | |
|---|---|---|---|
| 986,333 | 3/1911 | Wetmore | 53/355 |
| 2,359,562 | 10/1944 | Kantor | 53/342 |
| 3,425,187 | 2/1969 | Broetzler | 53/344 |
| 3,585,787 | 6/1971 | Podesta | 53/344 |
| 3,889,451 | 6/1975 | Burkhardt | 53/342 |
| 3,946,540 | 3/1976 | Solberg et al. | 53/341 |
| 4,205,502 | 6/1980 | Ahlers | 53/367 X |

*Primary Examiner*—James F. Coan
*Assistant Examiner*—Steven P. Weihrouch
*Attorney, Agent, or Firm*—Toren, McGeady

[57] ABSTRACT

An apparatus for closing bottles by means of closure caps, such as, crown caps or the like, including a closing machine, a closing member rotating together with a bell-type centering or guard member along the periphery of the closing machine. A spring-biased pressure die is mounted in the closing member so as to be movable in axial direction. A cap transfer station is arranged at one point of the cycle of rotation of the closing machine. The position of the centering member with a cap support member is adjustable relative to the pressure die during the movement. The centering member and cap support member, when in the cap transfer position, are fixedly supported on the closing member by means of the pressure die and/or by means of control members of the centering member.

5 Claims, 2 Drawing Sheets

1
14
12
13
4
8
5
7

APPARATUS FOR CLOSING BOTTLES

BACKGROUND OF THE INVENTION

1. Field of the Invention

The present invention relates to an apparatus for closing bottles by means of closure caps, such as, crown caps or the like. The apparatus includes a closing machine. A closing member rotates together with a bell-type centering or guide member along the periphery of the closing machine. A spring-biased pressure die is mounted in the closing member so as to be movable in axial direction. At one point of the cycle of rotation of the closing machine is arranged a cap transfer station.

2. Description of the Prior Art

Closing machines of the above-described type are used particularly in the beverage industry for closing reusable beverage containers, such as, bottles or the like. The closures are preferably crown caps which, after they have been placed on the bottle mouth, are closed by moving a pressure die. The known closing machines used for this purpose have a plurality of individual closing members which are mounted on the periphery of the closing machine and are controlled by means of cam surfaces. A bell-type centering or guide member is connected to each closing member. The centering member has the purpose to center the inserted bottles and simultaneously to receive a cap from the cap transfer station during the rotation of the closing machine. The cap is connected to the bottle by lowering the closing member which results in an axial movement of the pressure die.

When different types of bottles are used, it may happen during the movement of the closing member that the shoulder of a bottle is placed relatively high, such that the bottle is forced against the centering member and is destroyed by the centering member as a result. In order to overcome this problem, it has already been suggested to provide centering members which are unilaterally swivelably mounted and are movable upwardly and downwardly against the force of a spring. Such centering members have the disadvantage that, after some time of usage of the centering member, its bearing points become worn and the spring force required for lowering weakens, so that significant problems may occur particularly at the point where caps are transferred from the cap transfer station.

It is, therefore, the primary object of the present invention to provide an apparatus for closing bottles in which the centering or guide member has a certain mobility in dependence upon the relative movement of the pressure die, such that, when the pressure die is raised by the bottle neck, the centering member follows the pressure die with a certain play and, when the pressure die is lowered into its initial position or lower position, the centering member is also taken along into this lower position.

SUMMARY OF THE INVENTION

In accordance with the present invention, the apparatus for closing bottles includes a centering member with cap support member, wherein the position of the centering member with the cap support member is adjustable relative to the pressure die during the closing movement, and wherein the centering member with cap support member, when in the cap transfer position, are fixably supported on the closing member by means of the pressure die and/or by means of control members of the centering member.

In accordance with an advantageous feature of the invention, the centering member is capable of remaining in its position when the pressure die is raised for the purpose of fixing the cap to the bottle. After the pressure die has traveled a certain distance, the die takes along the centering member. After the closed bottle has been removed, the die then returns the centering member into the initial position.

In accordance with another feature of the invention, in the event that a bottle has a high shoulder, the centering member is capable of following the movement of the pressure die independently of the movement of the pressure die.

The apparatus according to the present invention makes it possible to process different types of bottles, i.e., bottles having different shoulder heights, without the closing members destroying the bottles during the closing procedure. As soon as the pressure die moves relative to the closing member, automatically certain play is obtained for the axial movement of the centering member, so that a higher bottle shoulder can move the centering member upwardly without encountering any significant resistance. On the other hand, when the pressure die is moved further in axial direction, the centering member is automatically carried upwardly after a certain distance has been traveled. Although the centering member is capable of carrying out this bottle-saving movement, after the now closed bottle has been removed and prior to the transfer of a cap, the centering member is controlled by the pressure die to return automatically into the lower initial position required for the transfer of a cap. As a result, it is ensured that the centering member with its cap support member maintains exactly the adjusted transfer level.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the drawing.

DETAILED DESCRIPTION OF THE INVENTION

Figure 1:
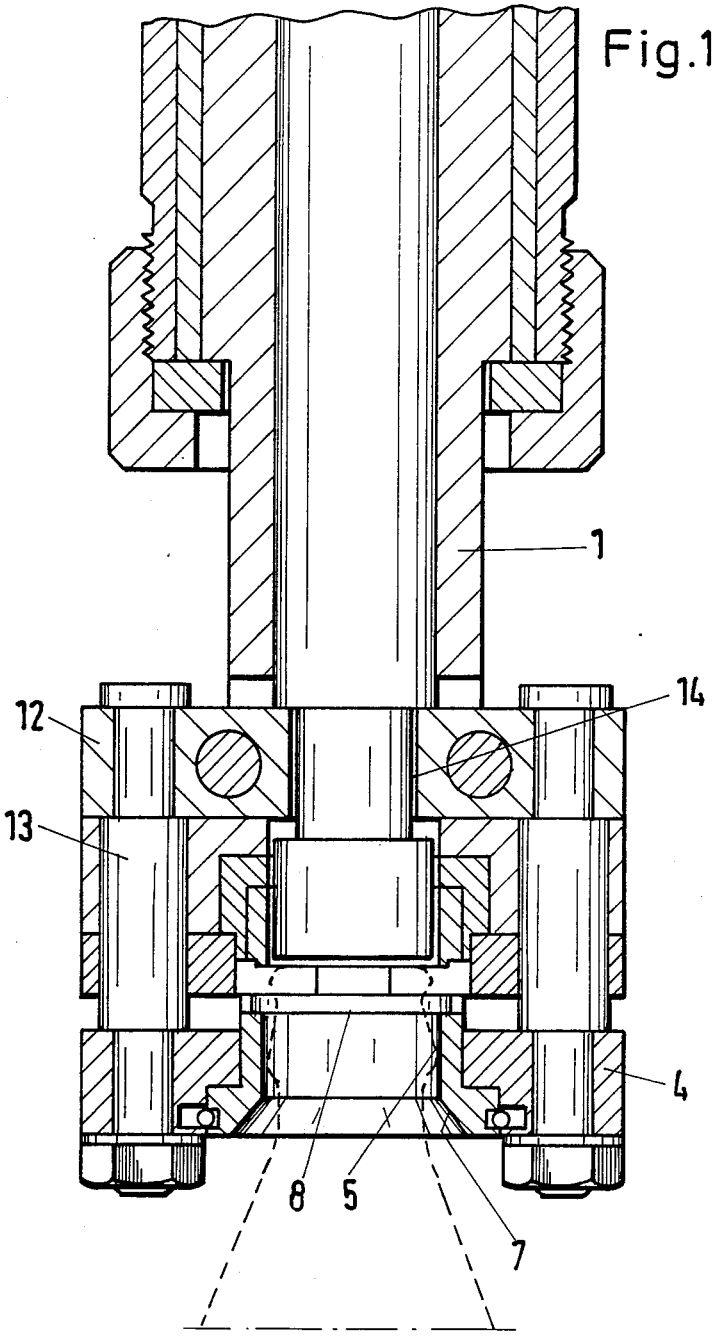
FIG. 1 is a schematic cross-sectional view of the lower portion of a closing apparatus according to the present invention.

As illustrated in the drawing, the apparatus for closing bottles according to the present invention includes a closing member 1 which is only partially illustrated. A spring-biased pressure or closing die 2 is mounted in closing member 1 so as to be movable upwardly and downwardly in axial direction. A bell-type centering or guide member is provided underneath pressure die 2. Centering member 4 has a cylindrical portion 5 for centering a bottle mouth 6 and a lower, slightly conical portion 7 for the initial centering of the bottle mouth 6 to be introduced. Centering member 4 has an upper portion 8 facing the lower end face 3 of the pressure die 2. Member 8 serves to receive a crown cap 9. The closing members 1 are mounted on the periphery of a closing machine. The crown cap 9 is added to each closing unit during the rotation of the closing machine in the area of the schematically illustrated cap transfer station 10. The crown cap 9 is then supported by member 8 of centering member 4.

Figure 2:
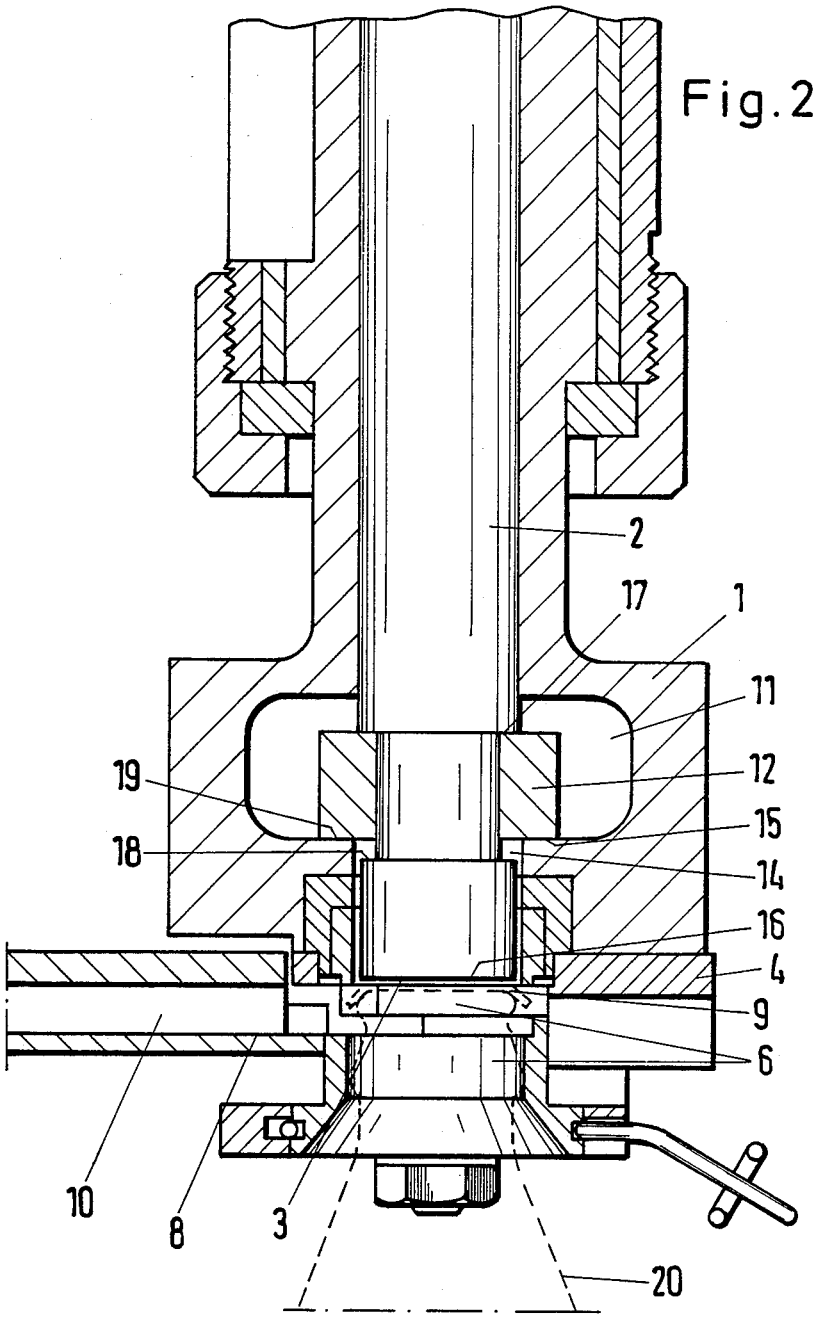
FIG. 2 is another schematic cross-sectional view of the closing apparatus including a cap transfer station.

As specifically illustrated in FIG. 2, closing member 1 has a recess 11. Control members 12 of centering member 4 extend through recess 11. Control members 12 are connected to the centering member 4 itself by means of guide bolts 13. Control members 12 are received by pressure die 2 in a recess 14 which has a length which is greater than the height of the control members 12 guided therein. In the lower position, the control members 12 and the lower end face 15 of recess 11 forms a stop for the pressure die 2 whose recess 14, as already described above, is longer than the height of the control members 12.

The closing member 1 is moved downwardly as soon as a bottle has been placed on a lower support plate and a crown cap 9 has been received by the centering member 4. As a result, pressure die 2 rests with its lower end face 16 against the upper surface of crown cap 9. When the closing member 1 is moved farther downwardly for pressing on the crown cap 9, the upper stop surface 17 of recess 14 is raised from control members 12 of centering member 4, so that the latter is held within the closing member 1 so as to be freely movable relative to pressure die 2 to an increasing extent. As soon as a further relative movement takes place between closing member 1 and pressure die 2, the lower stop surface 18 reaches the bottom side 19 of control members 12, so that the entire centering member 4 is automatically taken along by the pressure die 2 and, thus, any slight load possibly placed on the bottle shoulder 20 is removed. Nevertheless, during the intermediate movement, as described above, a certain play has been obtained between the control members 12 of centering member 4 and the lower and upper stop surfaces 17, 18 of recess 14, so that the entire centering member can be moved upwardly without problems by a bottle which may have a high shoulder 20.

As soon as the bottle has been provided with the crown cap 9, the closing member 1 is raised and the bottle is released from the centering member 4. Immediately thereafter, the centering member 4 has to be moved to such a level that it can receive a new crown cap 9 in the region of the cap transfer station 10. This result is achieved by upper stop surface 17 of recess 14 of pressure die 2 which rests against the upper end face of control members 12 and moves in a forced manner the control members 12 against the stop surface 15 of recesses 11 in closing member 1, so that the lower position of centering member 4 or of cap support member 8 required for the transfer of a cap has been ensured.

Thus, the illustrated embodiment of the closing apparatus according to the present invention allows a relative movement of the centering member 4 within a certain range and subsequently a forced movement of the centering member 4 by means of the respective stop surfaces of the pressure die 2. In addition, a relative movement between pressure die 2 and centering member 4 can be carried out when a bottle with a high shoulder is encountered, so that bottle breakage, which would otherwise be inevitable, is effectively prevented. On the other hand, as described above, the closing apparatus according to the present invention is capable of forceably moving the centering member 4 with the cap support member 8 into the lower position required for the transfer of a cap.

While a specific embodiment of the invention has been shown and described in cdetail to illustrate the application of the inventive principles, it will be understood that the invention may be embodied otherwise without departing from such principles.

I claim:

1. An apparatus for closing bottles by means of closure caps, including a closing machine, a closing member and a bell-type centering member connected to the closing member, the closing member and the centering member rotating along the periphery of the closing machine, a spring-biased pressure die mounted in the closing member so as to be movable in axial direction, a cap transfer station arranged at one point of the cycle of rotation of the closing machine, wherein the improvement comprises that the centering member including a cap support member is movable relative to the pressure die and the closing member, the centering member including the cap support member, when in a cap transfer position, being fixably supported on the closing member by means of the pressure die and by means of control members of the centering member.

2. The apparatus according to claim 1, wherein the centering member is configured to remain in its position when the pressure die is raised, and wherein, after the pressure die has traveled a certain distance, the centering member is taken along by the pressure die, and wherein, after the closed bottle has been removed, the centering member is returned into its initial position by means of the pressure die.

3. The apparatus according to claim 1, wherein when the centering member encounters a bottle with high shoulder, the centering member is configured to be moved to follow the movement of the pressure die independently of the movement of the pressure die.

4. The apparatus according to claim 1, wherein the pressure die defines a recess, the recess receiving the control members of the centering member and having a length which is greater than the height of the control members, and wherein the control members, when in the lower position, define with the closing member a lower stop for the pressure die.

5. The apparatus according to claim 1, wherein the centering member is connected to the control members by means of guide bolts.

* * * * *